US008919838B2

(12) United States Patent
Zimmermann et al.

(10) Patent No.: US 8,919,838 B2
(45) Date of Patent: Dec. 30, 2014

(54) FOOD HANDLING DEVICE

(71) Applicant: Poi Domani Marketing Products, LLC, Astoria, NY (US)

(72) Inventors: Eric Zimmermann, Astoria, NY (US); Daniel J. Ferrara, Levittown, NY (US)

(73) Assignee: Poi Domani Marketing Products, LLC, Astoria, NY (US)

( * ) Notice: Subject to any disclaimer, the term of this patent is extended or adjusted under 35 U.S.C. 154(b) by 0 days.

(21) Appl. No.: 13/651,334

(22) Filed: Oct. 12, 2012

(65) Prior Publication Data

US 2013/0277993 A1 Oct. 24, 2013

Related U.S. Application Data

(63) Continuation-in-part of application No. 12/682,890, filed on Apr. 13, 2010, now Pat. No. 8,419,092, which is a continuation of application No. PCT/US2008/072711, filed on Aug. 8, 2008.

(60) Provisional application No. 60/935,393, filed on Aug. 10, 2007.

(51) Int. Cl.

| | |
|---|---|
| ***B65G 7/12*** | (2006.01) |
| ***A47G 21/00*** | (2006.01) |
| ***A47G 21/10*** | (2006.01) |

(52) U.S. Cl.

CPC ..... *A47G 21/001* (2013.01); *A47G 21/10* (2013.01)

USPC ..... 294/25; 2/16; 2/21

(58) Field of Classification Search

USPC ..... 294/1.3, 28, 33, 99.2, 176; 2/16, 21, 2/160, 163; 446/26, 329; 473/503, 205, 473/458; 482/44, 47, 48, 49

See application file for complete search history.

(56) References Cited

U.S. PATENT DOCUMENTS

| | | | |
|---|---|---|---|
| 502,896 | A | 8/1893 | Vine |
| 1,156,459 | A | 10/1915 | Brown |

(Continued)

FOREIGN PATENT DOCUMENTS

| | | |
|---|---|---|
| FR | 1369291 | 6/1964 |
| FR | 2786678 | 6/2000 |

(Continued)

OTHER PUBLICATIONS

International Search Report for PCT/US2008/072711 dated Feb. 26, 2009, 1 page.

(Continued)

*Primary Examiner* — Stephen Vu
(74) *Attorney, Agent, or Firm* — Collard & Roe, P.C.

(57) ABSTRACT

There is disclosed an eating utensil design for providing comfortable control of certain food. A user of the utensil can grasp the utensil which has at least three digit elements for grasping food. An example of the three digit elements are in the form of three channeled compartments for receiving a person's digits or digits. Any three digits or digits can be used such as the thumb or the four other digits. The most common implementation includes using the thumb in one channel, and the index digit and the middle digit in two opposing channels. Thus an eating utensil is provided that allows comfortable and efficient manipulation of food while shielding the digits from sauces and that can be quickly and single-handedly grasped for use and released.

19 Claims, 20 Drawing Sheets

(56) References Cited

U.S. PATENT DOCUMENTS

| | | | | |
|---|---|---|---|---|
| 3,103,213 | A | 9/1963 | Robinson | |
| 3,501,191 | A | 3/1970 | Darr | |
| 3,593,803 | A | 7/1971 | Ibach | |
| 4,038,787 | A | 8/1977 | Bianchi | |
| 4,261,608 | A | 4/1981 | Bradshaw | |
| 4,675,914 | A | 6/1987 | Mitchell | |
| 4,728,130 | A | 3/1988 | Corzine | |
| 4,751,747 | A | 6/1988 | Banks et al. | |
| 4,867,246 | A | 9/1989 | Kiger | |
| 4,961,568 | A | 10/1990 | Clark et al. | |
| 5,359,840 | A | 11/1994 | Costar | |
| 5,568,957 | A | 10/1996 | Haugs | |
| 5,649,728 | A | 7/1997 | Warthen | |
| 5,653,488 | A | 8/1997 | Ordonez | |
| 5,661,853 | A | 9/1997 | Wilmot | |
| 5,709,423 | A | 1/1998 | Romero | |
| 5,749,097 | A | 5/1998 | Garrett-Roe | |
| 5,848,928 | A | 12/1998 | Wong | |
| 6,089,631 | A | 7/2000 | Thurlow et al. | |
| 6,145,128 | A * | 11/2000 | Suzuki | 2/21 |
| 6,276,734 | B1 | 8/2001 | Krieger | |
| 6,918,137 | B2 | 7/2005 | Fowler | |
| 6,944,914 | B2 | 9/2005 | Tillim | |
| 7,165,270 | B2 | 1/2007 | De Young et al. | |
| 7,287,791 | B2 | 10/2007 | Carolina | |
| 2003/0131393 | A1 | 7/2003 | Votolato | |
| 2003/0190997 | A1 | 10/2003 | Siek | |
| 2006/0249967 | A1 | 11/2006 | Carolina | |

FOREIGN PATENT DOCUMENTS

| | | | |
|---|---|---|---|
| JP | 62114016 | | 5/1987 |
| JP | H02138651 | | 11/1990 |
| JP | H08395 | | 2/1996 |
| JP | 2001-252169 | A | 9/2001 |
| KR | 2019990037804 | | 10/1999 |
| WO | 98/30138 | A1 | 7/1998 |
| WO | 2006046086 | A1 | 5/2006 |
| WO | 2007117067 | A1 | 10/2007 |
| WO | 2009/023600 | A2 | 2/2009 |

OTHER PUBLICATIONS

Supplementary European Search Report dated Oct. 19, 2011, 6 pages.

Written Opinion of the International Searching Authority and International Search Report, mailed Feb. 6, 2014, 6 pages.

* cited by examiner

FOOD HANDLING DEVICE

CROSS REFERENCE TO RELATED APPLICATIONS

This application is continuation in part application of U.S. patent application Ser. No. 12/682,890 filed on Apr. 13, 2010, wherein the '890 application is a continuation application of international application PCT/US2008/072711 filed on Aug. 8, 2008, and titled "Food Handling Device" wherein that application claims priority under 35 U.S.C. 119(e) from U.S. Provisional Application Ser. No. 60/935,393 filed on Aug. 10, 2007 wherein the disclosure of all of these applications including the '890 application, the '711 international application and the '393 provisional application are hereby incorporated herein by reference in their entirety.

BACKGROUND

At least one embodiment of the invention relates to a new type of eating utensil that enables users to comfortably manipulate food without the user's fingers coming into direct contact with the food. People often decide against eating foods such as chicken wings and barbequed pork ribs in order to avoid getting sauce on their hands and potentially their clothing. Even when conditions are acceptable for eating messy foods, people tend to avoid touching anything while their hands have sauce on them thereby precluding them from consuming beverages until they have finished eating the entire serving and have cleaned their hands. An additional benefit afforded by this device is the reduced likelihood of spreading disease causing viruses and bacteria. Thus, with this type of device there are also sanitation concerns that are addressed because now the user does not have direct contact with the food being handled except for directly eating the food instead of touching the food.

U.S. Pat. No. 5,709,423 to Romero discloses a food gripper utensil. This food gripper utensil does not contain more than two limbs. Other patents that may generally relate include U.S. Pat. No. 7,165,270 to DeYoung et al; U.S. Pat. No. 3,501,191 to L. Darr; U.S. Pat. No. 7,287,791 to Carolina; U.S. Pat. No. 4,728,130 to Oretti; and U.S. Pat. No. 6,276,734 to Krieger. U.S. Pat. No. 5,848,928 to Wong, U.S. Pat. No. 1,156,459 to Brown, U.S. Pat. No. 5,653,488 to Ordonez, and U.S. Pat. No. 5,649,728 to Warthen.

It is believed that the above art does not disclose a food handling device having at least three limbs and that is gripped along the center-line of the limbs of the utensil and is held by compression of the user's fingers against the limbs of the utensil which tend to flex into the open position.

SUMMARY

One embodiment of the invention relates to a food handing device comprising at least three limbs. The limbs comprise a first limb for receiving a first finger; a second limb for receiving a second finger; and a third limb for receiving a third finger. In this case while the term finger is used any type of digit such as a finger or a thumb can be used. In addition, there is at least one body section coupled to each of said first limb, said second limb, and said third limb said at least one body section forming at least one hinge for allowing at least one of said first limb, said second limb and said third limb to be movable about an axis formed on the body section. In this case, an optional but not required feature is that each limb can have at least one tooth.

Some of the benefits of this type device is that with three limbs, it offers greater stability for a user when that user is eating food. In addition, because there are three limbs, that user can then stand the device on its end such that the distal ends of the limbs opposite the body are used to support the device in an upstanding manner such as in the form of a tri-pod. This allows a user to easily insert his or her fingers into the open end of the device to grasp the gripping device and then pick it up.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION

Figure 1:
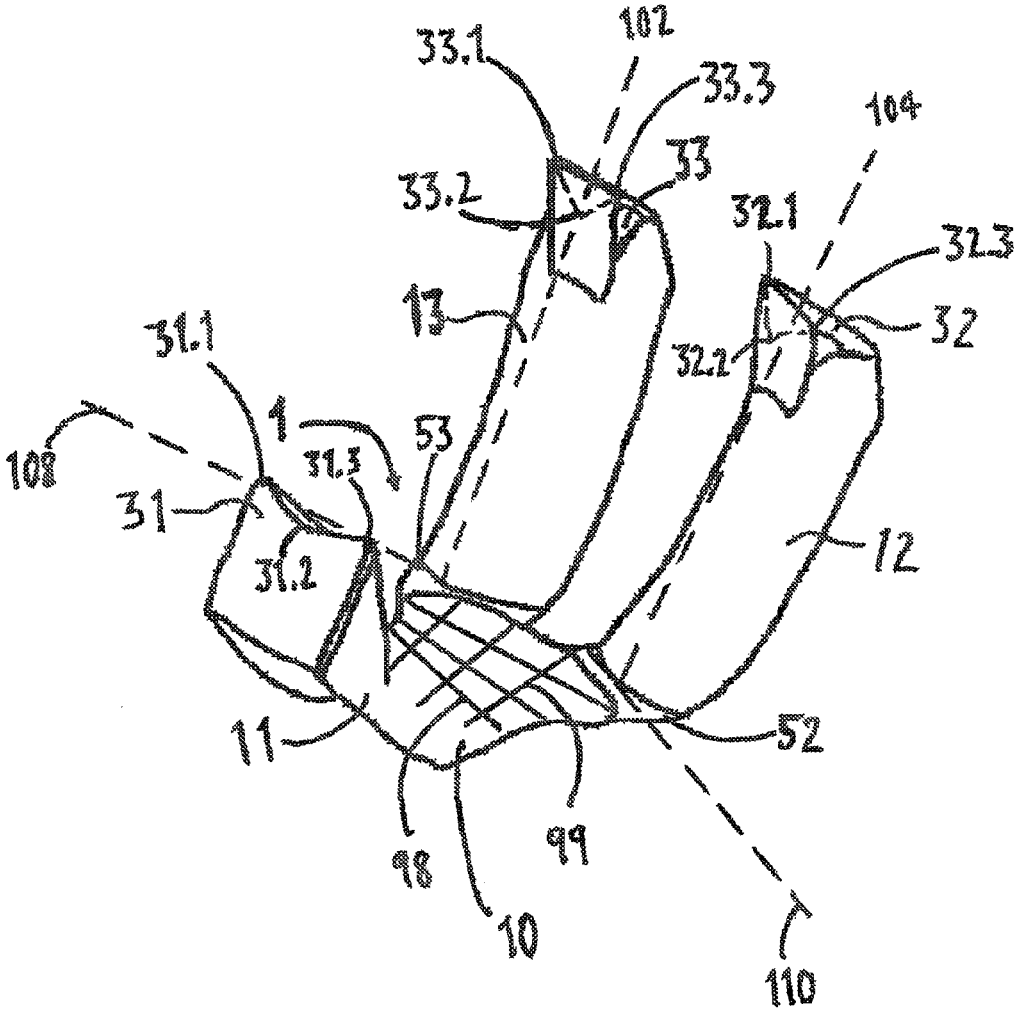
FIG. 1 is a perspective right-side view of a three-limbed version of the utensil constructed in accordance with the invention.

FIG. 1 is a perspective right-side top view of a three-limbed version of the device 1. The device includes a body section 10 which is coupled to first limb 11 in an integral manner. In addition, second limb 12 is coupled to body section via hinge 52, while third limb 13 is coupled to body section 10 via hinge 53. Hinges 52 and 53 can be in the form of any known hinge but in this example show living hinges. Living hinges are hinges that are formed from material that is usually integral with the two components that are hinged. In this case, these hinges 52 and 53 can also have a natural spring incorporated therein based upon the material properties of the living hinge. Therefore, when a user is not pressing down in limbs 11, 12 and 13, limbs 12 and 13 would naturally spring away from limb 11. First limb 11 has tooth 31 at its tip. Second limb 12 has tooth 32 formed at its tip. Third limb 13 has tooth 33 formed at its tip. These teeth can be in any shape but in this case, these teeth are shown ramp shaped. Alternatively, these teeth can be formed as concave having two prongs sticking out from each side.

For example, as shown in FIG. 1, tooth 31 has tooth points or tips 31.1 and 31.3 and recess point 31.2. Teeth 32 and 33 can be ramp shaped but also be formed as concave shaped teeth shown by the dashed lines. With this design, tooth 32 is formed in a concave manner or in a recessed "V" shape having tooth point 32.1 a recess point 32.2, and another tooth point 32.3. Tooth 33 can also optionally be formed with a tooth point 33.1 a recess point 32.2 and another tooth point 33.3. In addition, in this view, there are a plurality of reinforcing ribs 98 and 99 which essentially criss-cross each other and provide reinforcing support for the body section 10. In addition, as shown in this view, second limb 12 has a longitudinal axis 104 and a rotational axis 110 while third limb 113 has a longitudinal axis 102 and a rotational axis 108. Rotational axis 110 is transverse to longitudinal axis 104, while rotational axis 102 is transverse or normal to rotational axis 108. (See also FIGS. 9 and 10) In addition, while this embodiment shows a device having teeth, teeth in this case are optional and are not required for operation. Therefore, it is clear that this device and therefore the invention can also be implemented without the use of teeth (see dashed lines in FIG. 4 indicating an example of an embodiment with no teeth).

While the device can be made from various materials, the most feasible embodiment of the utensil can be made of plastic or other moldable material which is safe for contact with food as a limited use-product via conventional injection molding processes. However, other types of materials can be used such as cornstarch, cardboard, paper, wherein these materials can constitute a more environmentally friendly version. Other alternative materials such as rubber or other types of materials can be used such as a composite material or metal as well. Thus, while the device may be made inexpensively so that it is disposeable, a non-disposable version may be stamped, folded or otherwise forged of metal.

An edible version of this product can be made of food matter such as that derived from fibrous vegetables and molded in accordance with this invention and solidified with syrup or other coating such as that derived from oats or honey.

Figure 2:
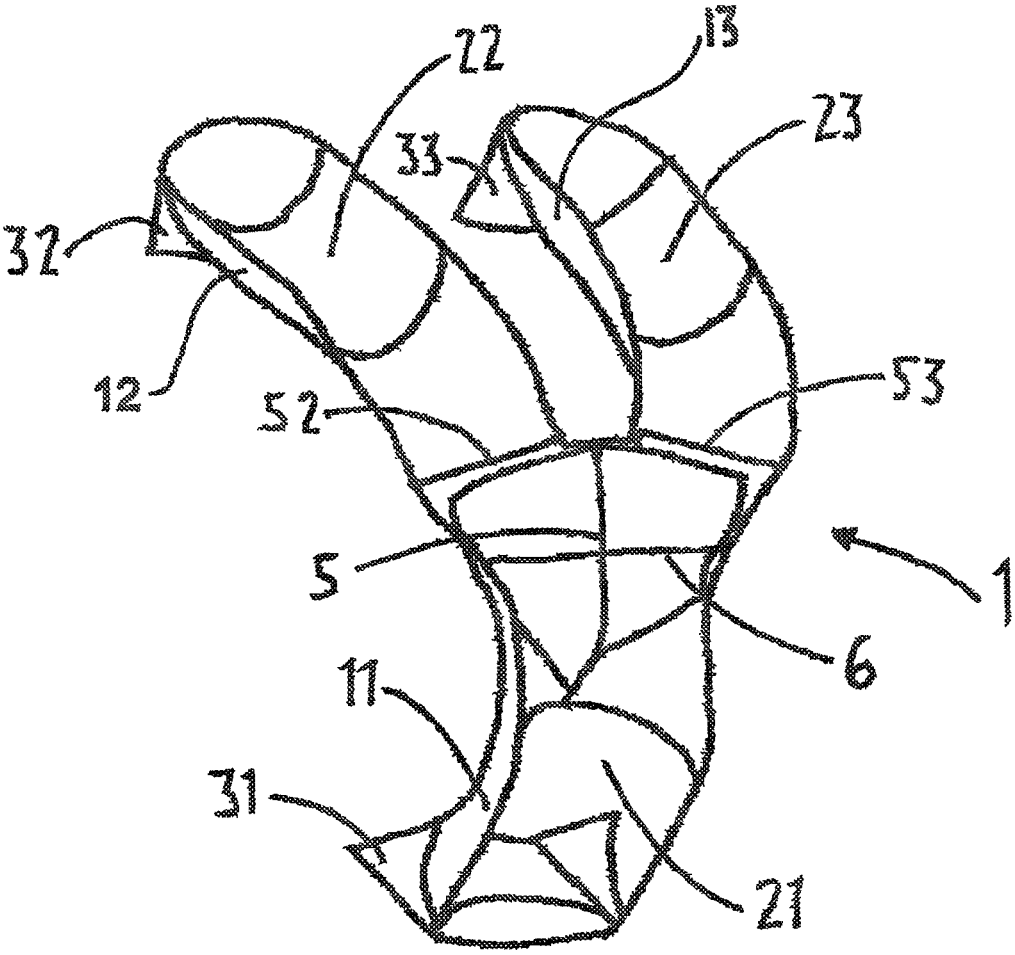
FIG. 2 is a perspective rear view of the utensil of FIG. 1 in the fully open position.

FIG. 2 is a perspective, rear view of the utensil of FIG. 1 in the fully open position. This view shows channels which are designed to receive a user's digits Each of these limbs form backside channels allowing a user to insert his or her fingers or digits into these channels to control the manipulation of these limbs 11, 12 and 13. This perspective is oriented in such a way so as to be grasped by the viewer with his or her right hand such that the thumb would rest in first finger channel 21 on first limb 11, the index finger would rest in second finger channel 22 on second limb 12, and the middle finger of the right hand would rest in third finger channel 23 on third limb 13. Second limb 12 meets the body of first limb 11 at second limb hinge 52. Third limb 13 meets the body of first limb 11 at third limb hinge 53. Channels 21, 22 and 23 each have two sides and a closed end at the end of the limb opposite the body section 10.

Figure 3:
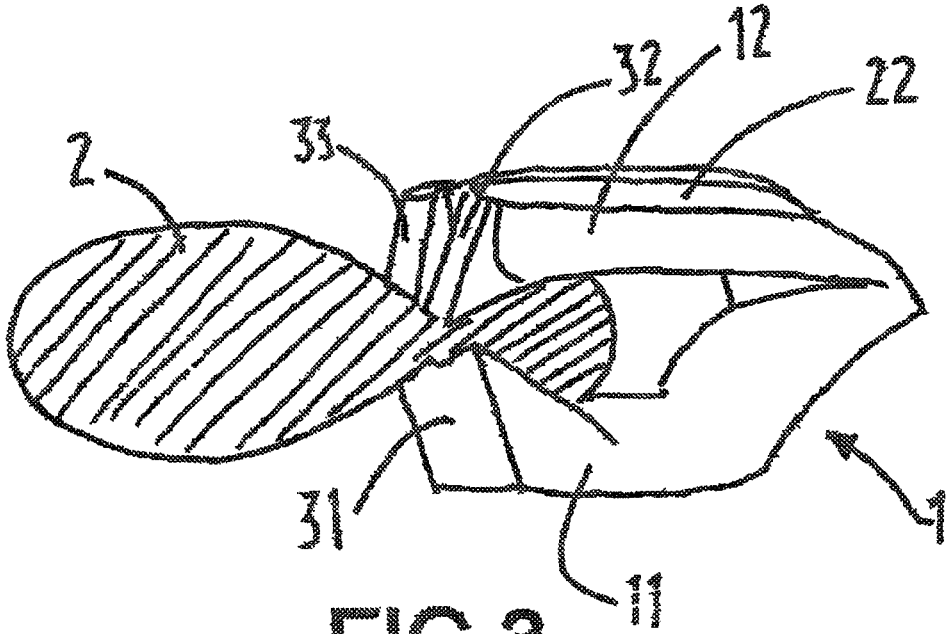
FIG. 3 is a perspective front right-side view of the utensil of FIGS. 1 and 2 compressed to grasp a chicken leg.

FIG. 3 is a perspective front right-side view of the utensil of FIGS. 1 and 2 compressed to grasp food 2. The user's hand is implied by the compression on the utensil but is not shown in this figure so as not to obscure the view of the utensil. The food item in this drawing is a chicken leg. This view shows the utensil in such a way that the user has grasped the chicken leg such that the limb teeth 31, 32, and 33 are behind the condile or end of the bone at the point of smallest bone diameter so as to minimize the potential for slippage.

Figure 4:
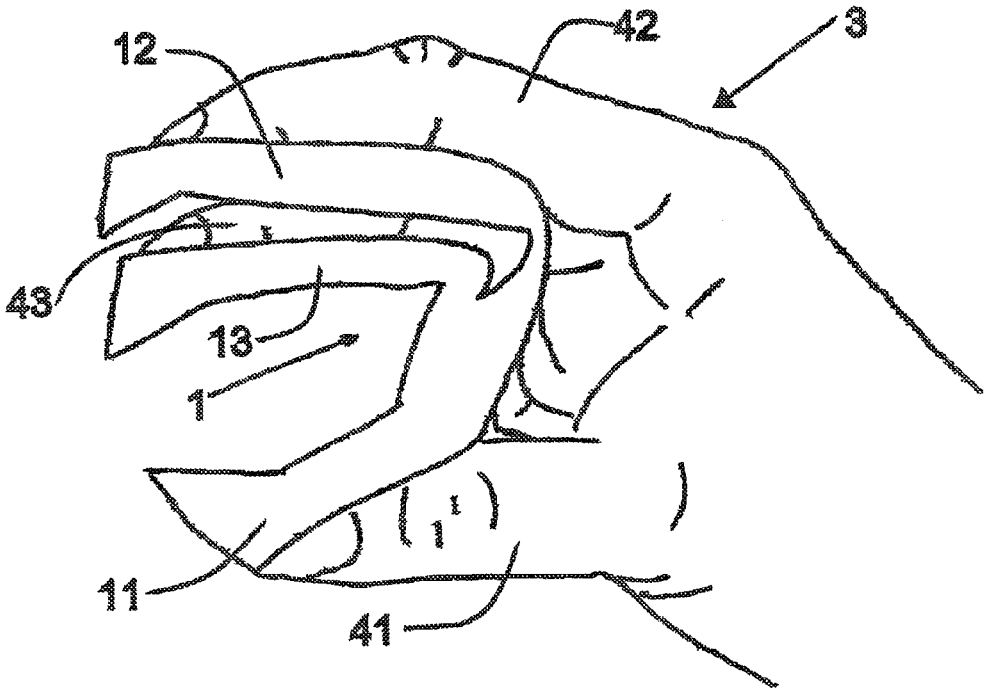
FIG. 4 is a perspective right side view of the utensil of FIGS. 1, 2, and 3 in hand and slightly compressed.

FIG. 4 is a perspective right side view of the utensil of FIGS. 1, 2, and 3 with the user's right hand shown and slightly compressed. Utensil 1 is held by hand 3 such that thumb 41 is in finger channel 21, second finger 42 is in finger channel 22 of utensil limb 12, and third finger 43 is in finger channel 23 of utensil limb 13. This view also shows additional hinges 120 and 130 which are used to create additional bend points in limbs 12 and 13 respectively.

Figure 5:
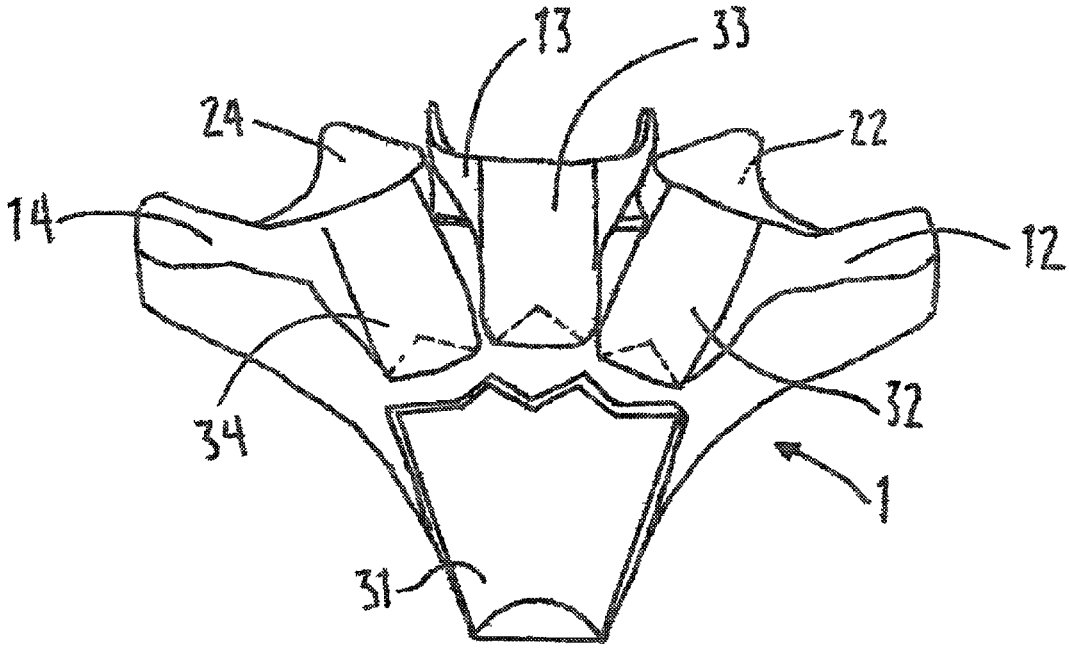
FIG. 5 is a front view of a four-limbed version of the utensil constructed in accordance with the invention in a slightly uncompressed position.

FIG. 5 is a front view of a four-limbed version of the utensil constructed in accordance with the invention in a slightly uncompressed position. This version of the utensil has all the elements of the three-limbed version of figures one through four but includes finger channel 24 of fourth-limb 14 with tooth 34 at it's tip.

Figure 6:
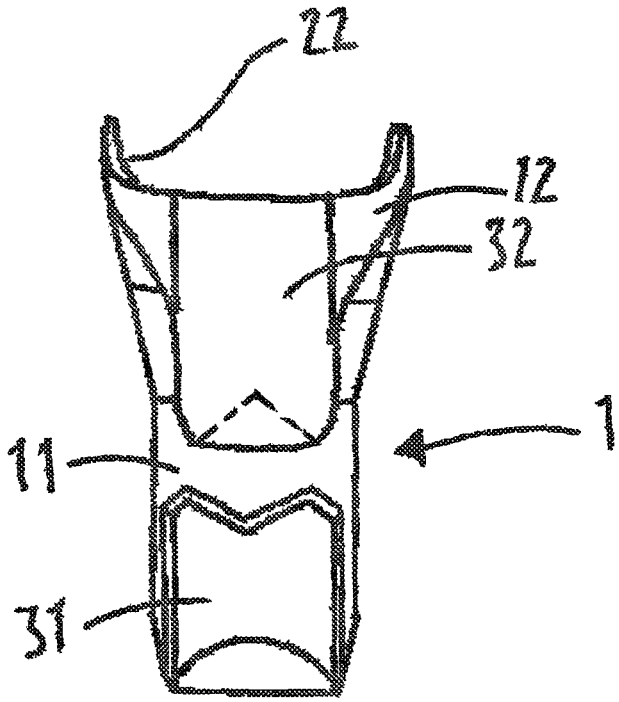
FIG. 6 is a front view of a two-limbed version of the utensil constructed in accordance with the invention in a slightly open position.

FIG. 6 is a front view of a two-limbed version of the utensil constructed in accordance with the invention in a slightly open position. This version only has first-limb 11 and second-limb 12 with the aforementioned associated teeth and finger channels. Second-limb 12 can be widened to accommodate more than one finger.

Figure 7:
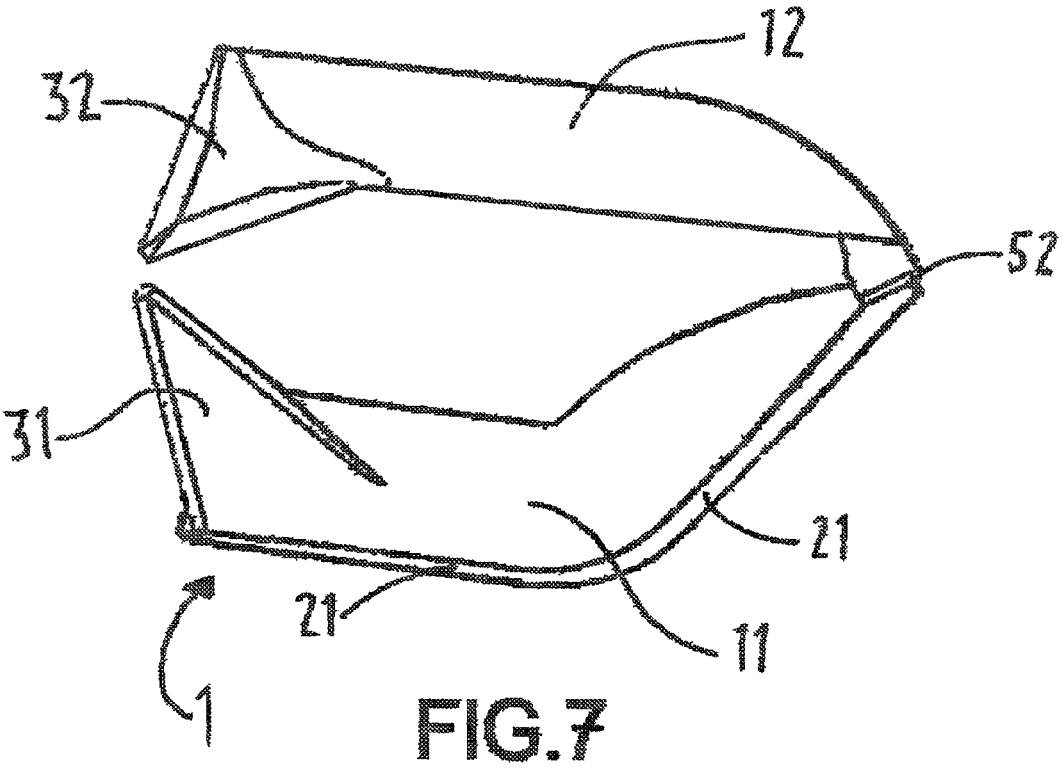
FIG. 7 is a side view of a two-limbed version of the utensil in a slightly open position.

FIG. 7 is a side view of a two-limbed version of the utensil of FIG. 6 in a slightly open position. This view affords perspective of second-limb hinge 52 which would be the only hinge of this embodiment. Although the first limb is shown with a bend for ergonomics and comfort, any limb can be either straight or curved.

Figure 8:
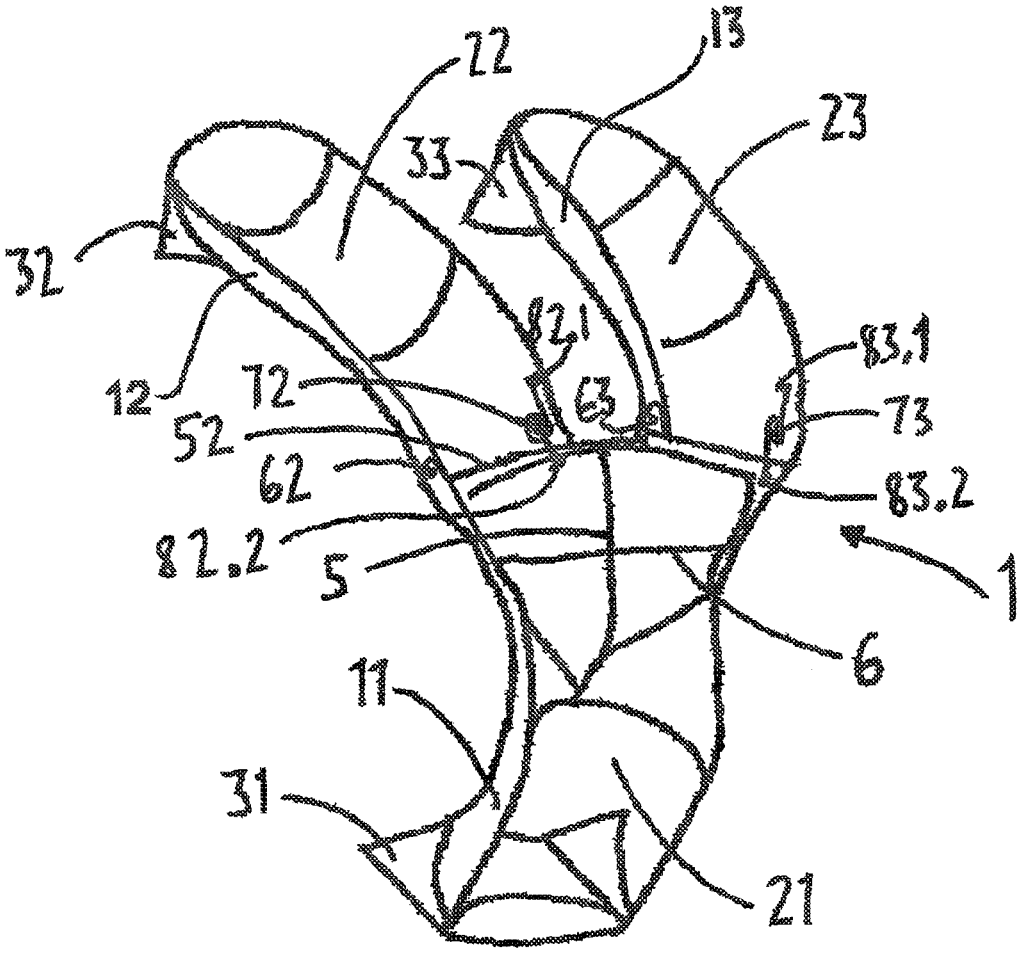
FIG. 8 is a perspective view of another embodiment.

FIG. 8 is a side view of a three limbed embodiment which has coil springs which are used as hinges. For example, there are two coil springs 72 and 73 wherein the first coil spring 72 is for second limb 12 and the second coil spring is for third limb 13. Each of these coil springs is fixed to their respective limbs via retainer pins. For example, spring 72 is secured at one end via second limb channel spring retainer pin 82.1, and at the opposite end via second limb body spring retainer pin 82.2. Spring 73 is secured at one end via third limb channel spring retainer pin 83.1 and at the opposite end via third limb body spring retainer pin 83.2. With this embodiment, limb 12 is coupled to body section 10 via a rotational hinge 62 while limb 13 is coupled to body section 10 via rotational hinge 63. With this design, with the benefit of coil springs, the device can have a snap back action which may be livelier than a living hinge of the other embodiments. In this case the snap back action allows the user to have a different level of feeling and control than with the device shown in FIG. 1 which has living hinges.

Figure 9:
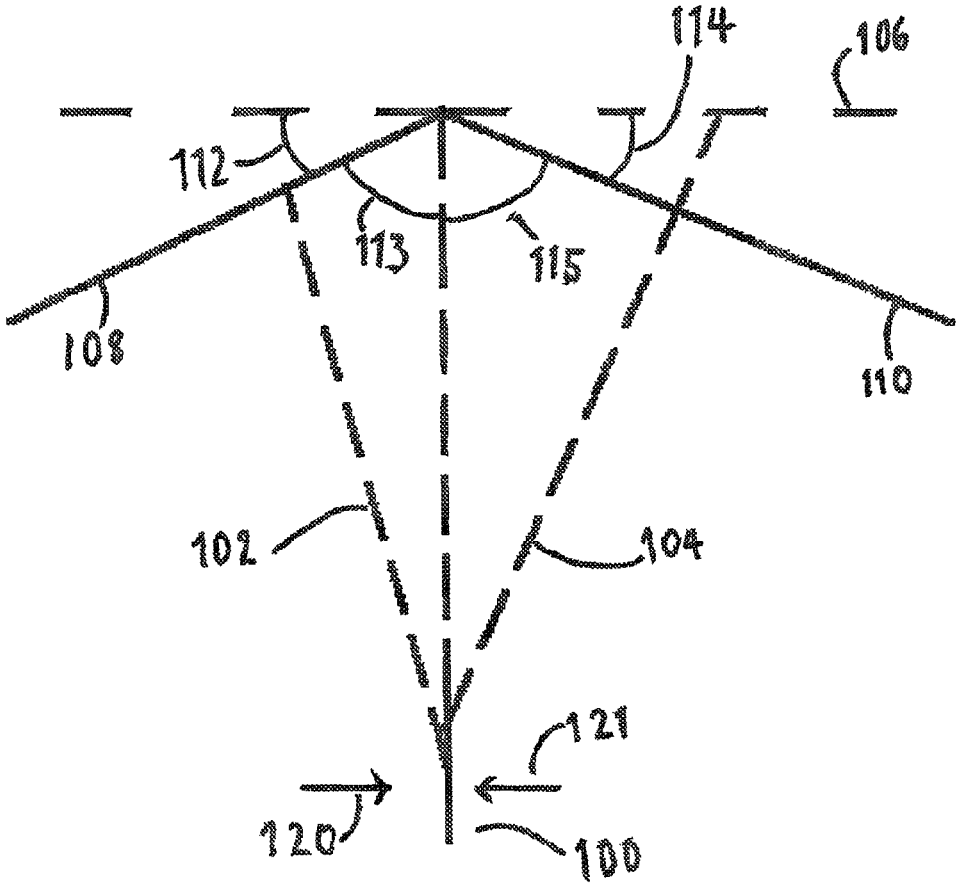
FIG. 9 is a view showing the axes of rotation and longitudinal axes of the limbs.

FIG. 9 is a view of the respective axes of the device wherein there is axis 100 which is the longitudinal axis of first finger 11. Second finger 12 has a longitudinal axis 104 while third finger has a longitudinal axis 102. Second finger 12 has a rotational axis 110 while third finger has a rotational axis 108. As discussed above, rotational axis 110 is transverse or perpendicular to longitudinal axis 104, while rotational axis 108 is transverse or perpendicular to longitudinal axis 102. There is also a transverse axis 106 which is transverse to longitudinal axis 100, this transverse axis 106 shows that axis of rotation 110 and axis of rotation 108 are offset from 90 degrees from longitudinal axis 100. This offset forms an offset angle 112 between rotational axis 108 and transverse axis 106 and an offset angle 114 between rotational axis 110 and transverse axis 106. These offset angles are complementary to acute angles 113 and 115 for respective rotational angles 108 and 110. The offset angles 112 and 114 are set so that second and third limbs 12 and 13 which are latitudinally offset from each other along transverse axis 106 rotate down so that their distal ends, or ends opposite their connection to body 10, are pressed in contact with each other or adjacent to each other when the device is closed or clamped down thereby creating pressure on a food item in at least a direction shown by arrows 120 and 121 to thereby stabilize the food item against movement via these forces. The food item is also clamped between the limbs via the clamping forces of first limb 11 and second and third limbs 112 and 113 respectively, clamping together as shown in FIG. 10.

Figure 10:
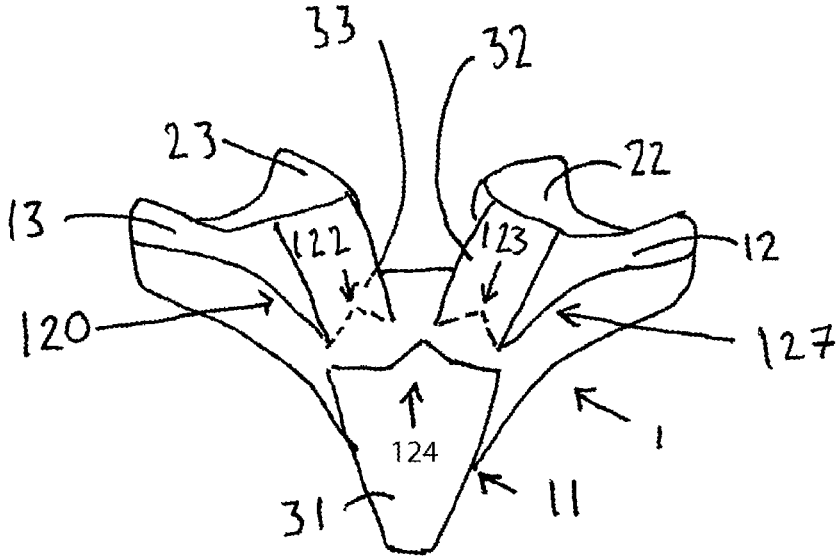
FIG. 10 is a view of the device shown in FIG. 1 in a closed position.

FIG. 10 shows a clamped position of the device shown in FIG. 1. In this case, there is shown second limb 12 and third limb 13 clamped down towards first limb 11 respective channels 22 and 23 for limbs 12 and 13 are also shown. In addition respective teeth 31, 32 and 33 are also shown for respective limbs 11, 12, and 13. Thus, when a user clamps down on second limb 12 and third limb 13 to draw second limb 12 and third limb 13 towards first limb 11, second limb 12 and third limb 13 move towards first limb 11 in a first dimension formed for example by arrows 122, 123, 124, and during this movement, second limb 12 and third limb 13 move towards each other as well in a second dimension shown by arrows 120 and 121.

In this view arrows 120 and 121 show the direction of lateral pressure that is applied when the limbs are clamped down. In addition arrows 122 and 123 show the direction of clamping pressure applied when the device is clamped down by a user's fingers. These arrows of pressure represent the helpful pressure that is applied when a user clamps down on the device. Because there are at least three fingers, this type of lateral pressure in the form of arrows 120 and 121 can be applied due to the offset angled settings of rotational axes 108 and 110. For example arrows 120 and 121 are shown extending substantially perpendicular to arrows 122 and 123 which show the different pressures applied to support food in a usable manner. If pressure was only applied along a single plane or dimension such as in the direction of arrows 122, 123 and 124, then this would result in a clumsy handling of food and an unenjoyable experience for the user. In the case of food such as wings, the wings might become unbalanced and slip out of the grip of the user. Thus with the lateral forces applied, the wings or other types of food such as ribs, steak, corn, chicken fingers, shrimp, etc, can be stabilized in a usable manner.

Essentially in at least one embodiment there is a food handing device comprising at least three limbs including a first limb 11 for receiving a first finger such as a thumb, a second limb 12 for receiving a second finger such as an index finger, and a third limb 13 for receiving a third finger. There is also at least one body section 10 coupled to each of the first limb 11, the second limb 12, and the third limb 13. Coupled to the body section are at least two hinges 52 and 53 for coupling the second limb 12 and the third limb 13 to body section 10, wherein these limbs 12 and 13 are independent of each other. These hinges 52 and 53 can be any type of hinges but comprise a first hinge in the form of a living hinge for allowing second limb 12 to be movable about a first rotational axis 110. There is also a second hinge 53 in the form of a living hinge allowing third limb 13 to be movable about a second rotational axis 108 which extends at a different angle relative to first rotational axis 110. In this case living hinges are hinges that allow bendable movement of two elements formed essentially integral with each other.

In one embodiment second limb 12 has a first end coupled to body section 10 and a second opposite or distal end. Second limb 12 has at least one additional hinge 120 disposed between the first end and the second opposite end, to create an articulating second limb as shown in FIG. 4.

The third limb 13 has a first end coupled to body section 10 and a second opposite end, wherein the third limb 13 has at least one additional hinge 130 disposed between the first end and the second or distal end, to create an articulating third limb 13. Due to the channels formed in these teeth such as channels 21, 22 and 23, these limbs are easily controllable by a user's fingers.

Figure 11:
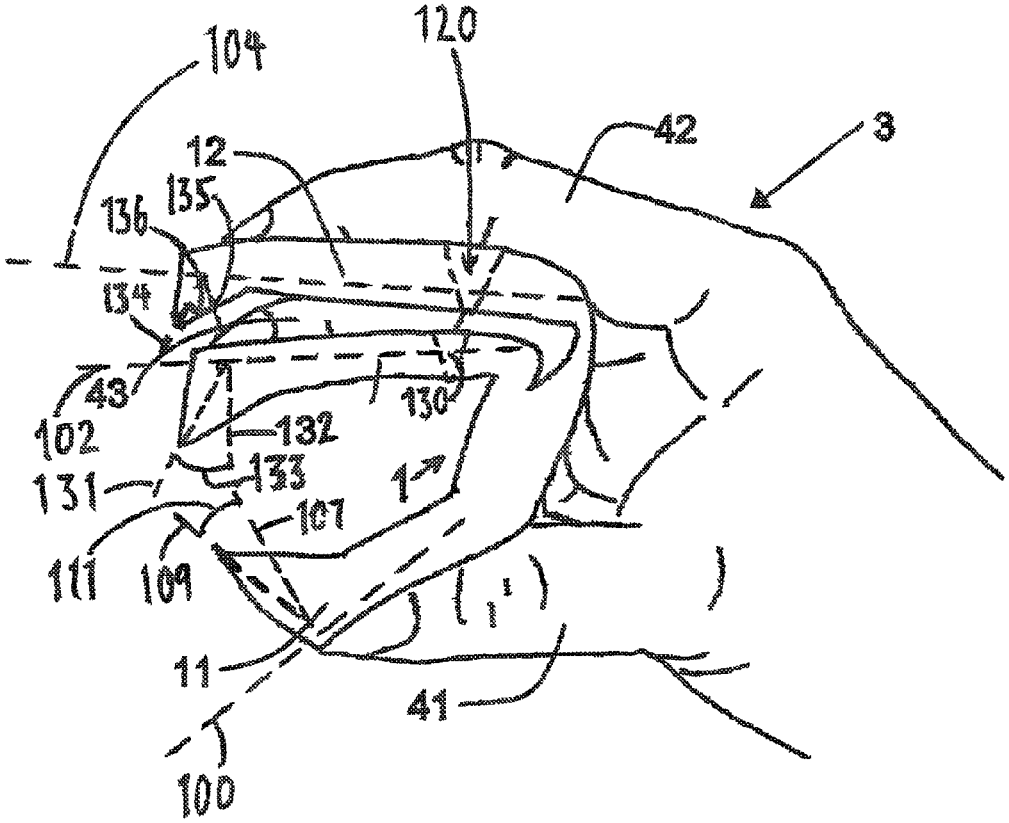
FIG. 11 is a modified view of FIG. 4.

FIG. 11 is a modified view of FIG. 4 which discloses the angles of extension of teeth 31, 32, and 33 relative to their respective limbs. For example, there is shown longitudinal axis 104 of second limb 12 wherein finger 42 which can be in the form of an index finger extends along this longitudinal axis in the channel for these teeth. Tooth 32 extends out from limb 12 along axis 134 which is offset from axis 135 via offset angle 136. Axis 135 is transverse or perpendicular to longitudinal axis 104. Similarly tooth 31 extends out from limb 11 along axis 109 which is offset from axis 107 via offset angle 111. Axis 107 is perpendicular to longitudinal axis 100 which is the longitudinal axis of limb 11. In addition, tooth 33 extends out from limb 13 along axis 131 which is offset from axis 132 via offset angle 133. These offset angles 111, 133 and 135 are such that it allows the extension of these teeth 31, 32, and 33 to extend out away from their respective limbs to allow a clamped down piece of food to be spaced away from a body or limb section of this device. Thus, because of offset angles 111, 133, and 136, the extension axis such as axes 109, 131 and 134 for each respective tooth 31, 32, and 33 intersects a respective longitudinal axis 100, 104, and 102 for a respective limb 11, 12, and 13 at an acute angle such that each tooth 31, 32, and 33 extends out away from each limb 11,12, and 13 to allow a user to grip food in a position away from each limb. Thus, one benefit of these offset extending teeth is that once the piece of food is clamped down upon, the food is spaced away from the body of the device so that a user can easily eat the food.

Figure 12:
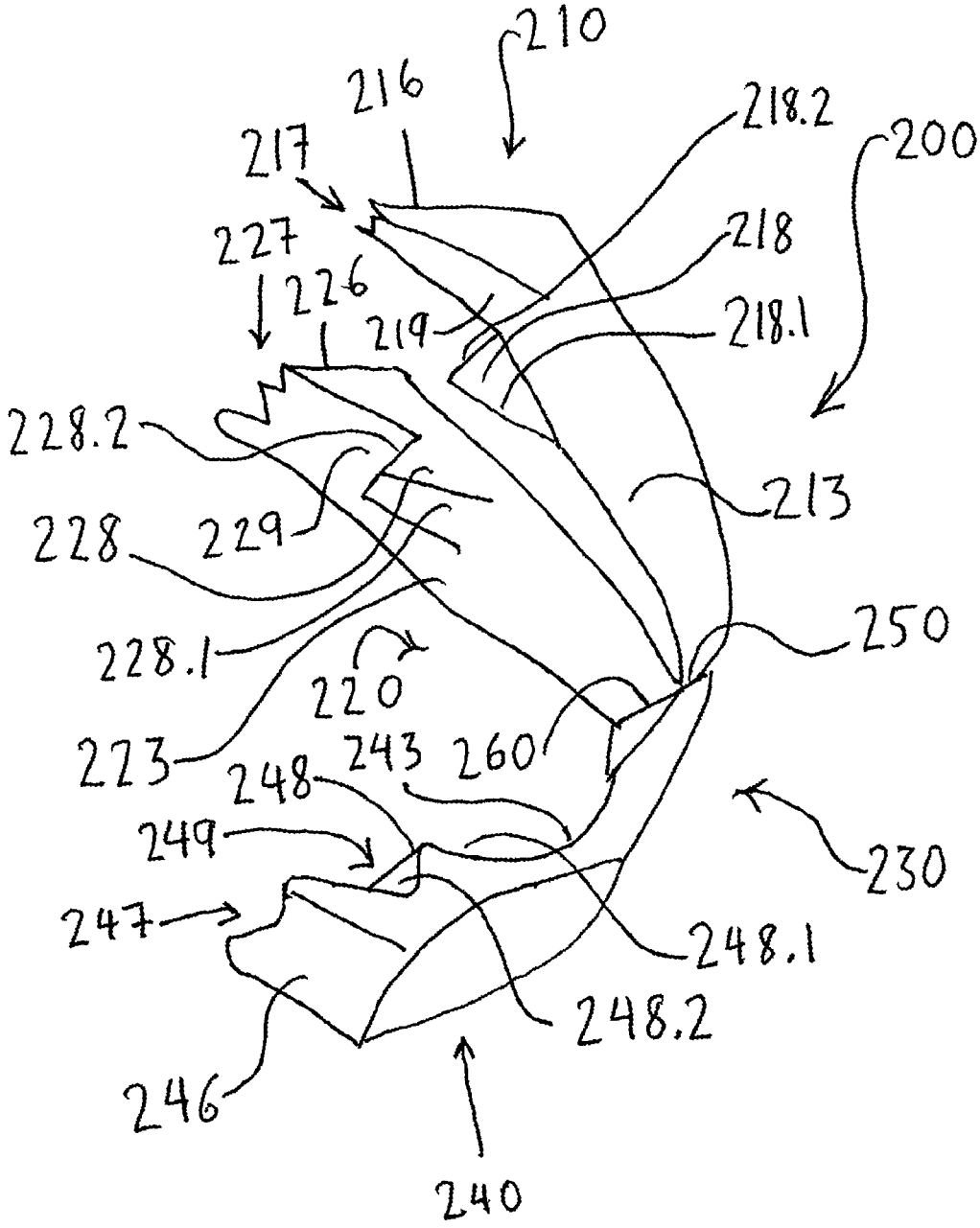
FIG. 12 is a perspective view of another embodiment.

FIG. 12 is a perspective view of another embodiment. This embodiment of a food handling device 200 includes a first leg 210, and a second leg 220 coupled to a body section 230. In addition, coupled to the body section 230 is another leg 240 as well. A plurality of hinges 250 and 260 are coupled to body section 230 as well. This device can be made from any suitable material such as an injection moldable plastic such as ABS plastic. Legs 210, 220 and 230 can also be referred to as extensions, appendages, limbs or members. Body 230 can also be referred to as a frame, chassis or trunk. This body section can have a flat back as well. Each leg 210, 220, 240 has an end cap 216, 226 and 246 with teeth or tines 217, 227, 247 extending therefrom. In addition, each leg 210, 220, 240, includes an inner surface 213, 223, and 243. Extending in from this inner surface is a respective protrusion 218, 228, 248 extending out from an inner surface of the respective leg. These protrusions 218, 228, and 248 can also be referred to as teeth as well. These protrusions 218, 228, and 248 are configured as ramp shaped protrusions with a substantially triangular cross-section, having a ramp section 218.1 228.1 and 248.1 and a corresponding back section 218.2, 228.2 and 248.2. This back section can be of any suitable shape such as flat but in this case is curved and creates a gap or recess region 219, 229, 249 adjacent to this curved back section 218.2, 228.2, and 248.2. Legs or limbs 210, and 220 are configured to rotate about hinges 250 and 260 to allow a user to close limbs 210 and 220 against limb 240. These hinges 250 and 260 are formed integral with these legs 210 and 220 and body section 230. These hinges rely on the flexibility of a weakened section of the region between body 230 and legs 210 and 220 which constitute hinges 250 and 260 form a natural spring, leaf spring, or living hinge configured to spring limbs 210 and 220 back away from limb 240. In addition, hinges 250 and 260 are configured to provide sufficient force such that a user gripping these limbs with his or her fingers has sufficient support on his or her fingers to hold the device without the need for a closed leg or limb. This allows for the configuration of open channels along the longitudinal axis of each of these limbs. For example, this design allows for the natural springing back of these limbs such that when the limbs are not engaged or in use, there is created an opening angle that can be any suitable angle such as between approximately 50-130 degrees open or approximately 60 degrees open shown as the angle $alpha_1(\alpha_1)$ in FIG. 13. These limbs are configured such that they are substantially stiff, except for any respective hinges.

Figure 13:
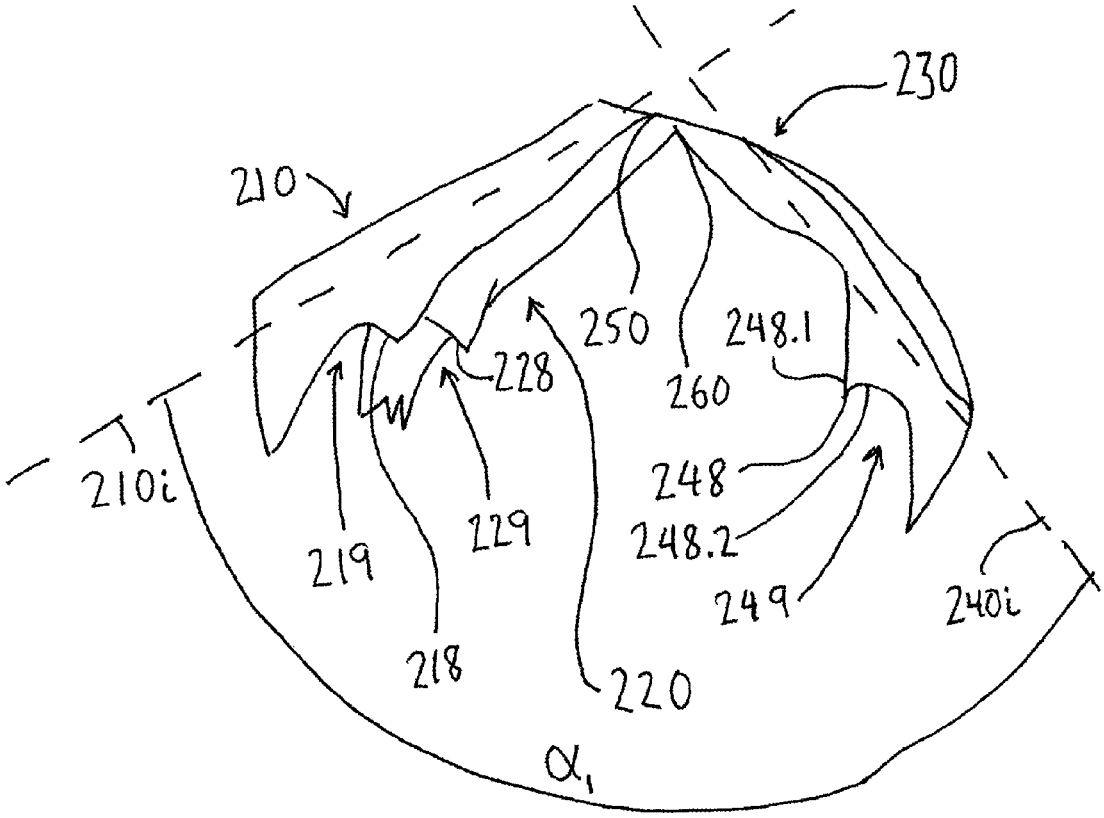
FIG. 13 is a side view of the embodiment of FIG. 12.

FIG. 13 also shows gaps 219, 229, and 249 formed from the distance of the apex or tip of the respective ramp sections 218.1, 228.1 and 248.1 from the inside face of the respective legs 213, 223, and 243. These gaps 219, 229 and 249 are also formed by the respective curved back ends 218.2, 228.2 and 248.2 of protrusions 218, 228, and 248 as well. FIG. 13 also shows longitudinal axes 210*i* and 240*i*. Longitudinal axis 210*i* extends along a length of leg 210, while longitudinal axis 240*i* extends along a length of leg 240 which may include at least a portion of body section 230 as well. Leg 240 is essentially formed integral with body section 230 so that it does not rotate about a hinge with respect to body section 230. The intersection of these two longitudinal axes form the angle $alpha_1$.

Figure 14:
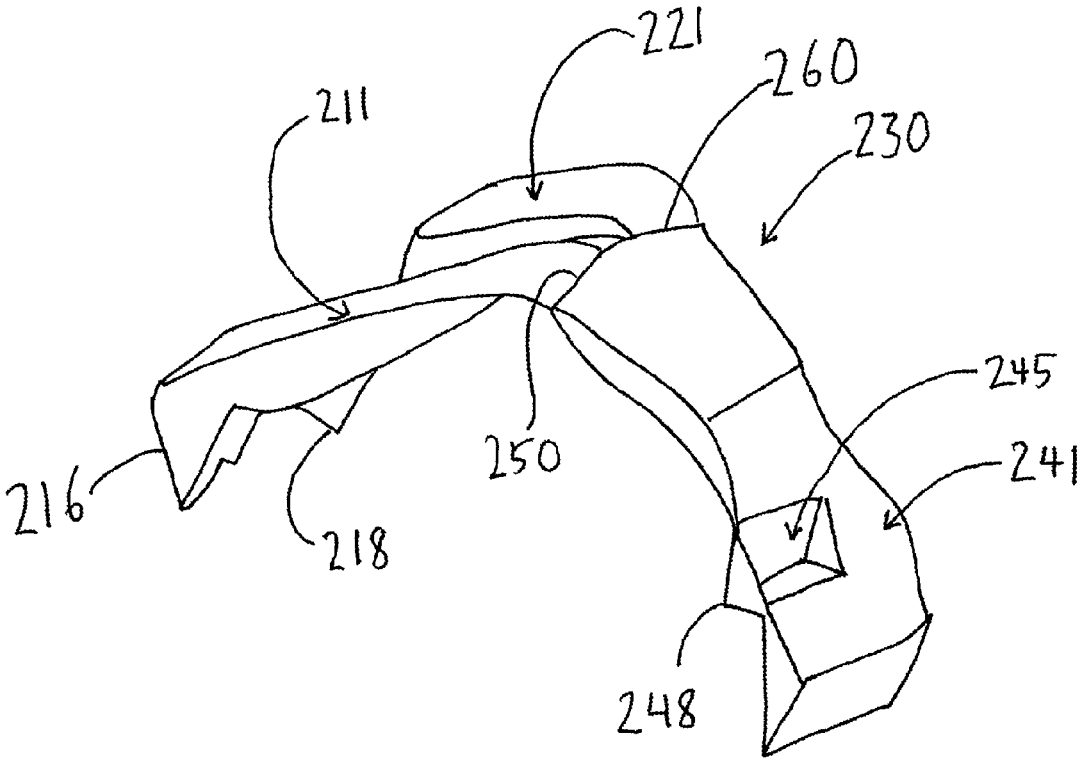
FIG. 14 is a back perspective view of the embodiment of FIG. 12.

FIG. 14 shows the back view of channels 211, and 221 as well as hinges 250 and 260. It also shows a flat back view of body 230 as well. Channel 241 is also shown which shows indented region 245 which is a complimentary shape of protrusion 248. Indent 245 can also be referred to as a dent, depression, rut, concave, push-in, cavity, or pit. Channels 211 and 221 can also be referred to as grooves and are formed as semi-circular or U-shaped open channels that are open along a substantial portion of the longitudinal extension of these channels.

Figure 15:
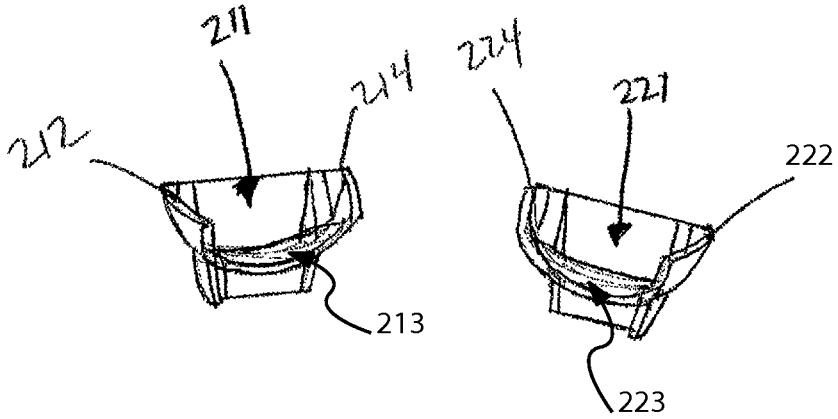
FIG. 15 is a cross-sectional view of the channels.

FIG. 15 shows channels 211 and 221 of limbs or legs 210 and 220 in greater detail. Channel 211 includes side walls 212, and 214, while channel 221 includes side walls 222, and 224. As shown these channels have a substantially U-shaped or semi-circular shape with an inside surface 213, and 223, and an open opposite region or top, allowing a user to simply apply his or her fingers to the channel from a movement substantially transverse to the longitudinal extension of the channels.

Figure 16:
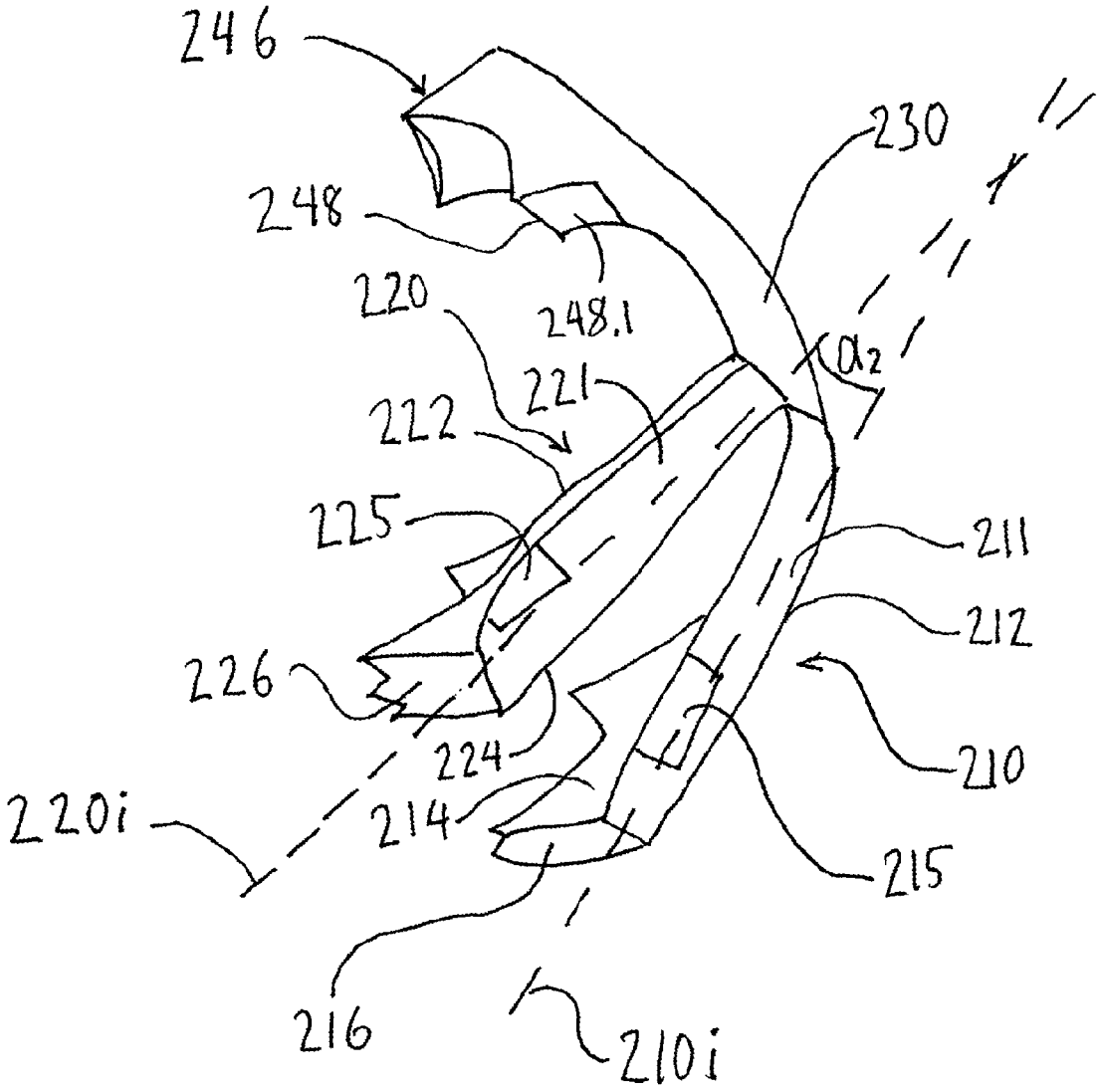
FIG. 16 is a back perspective view of the embodiment of FIG. 12 with the channels shown.

FIG. 16 shows a perspective view of this design which shows limbs 210 and 220 having channels 211 and 221 with longitudinal axes 210*i* and 220*i* extending along the longitudinal extension or length of these legs. These channels 211 and 221 having respective side walls 212, 214 and 222 and 224 are configured to receive digits of a person's hand As shown, these channels include indents 215 and 225 (See also FIG. 19) which allow a user's fingers greater grip inside of these channels 211 and 221. In addition, at an end of these channels 211 and 221 there are end caps or surfaces 216 and 226. These end caps 216 and 226, including end caps 246 form limited end covers for channels 211, 221, and 241 respectively.

Figure 17:
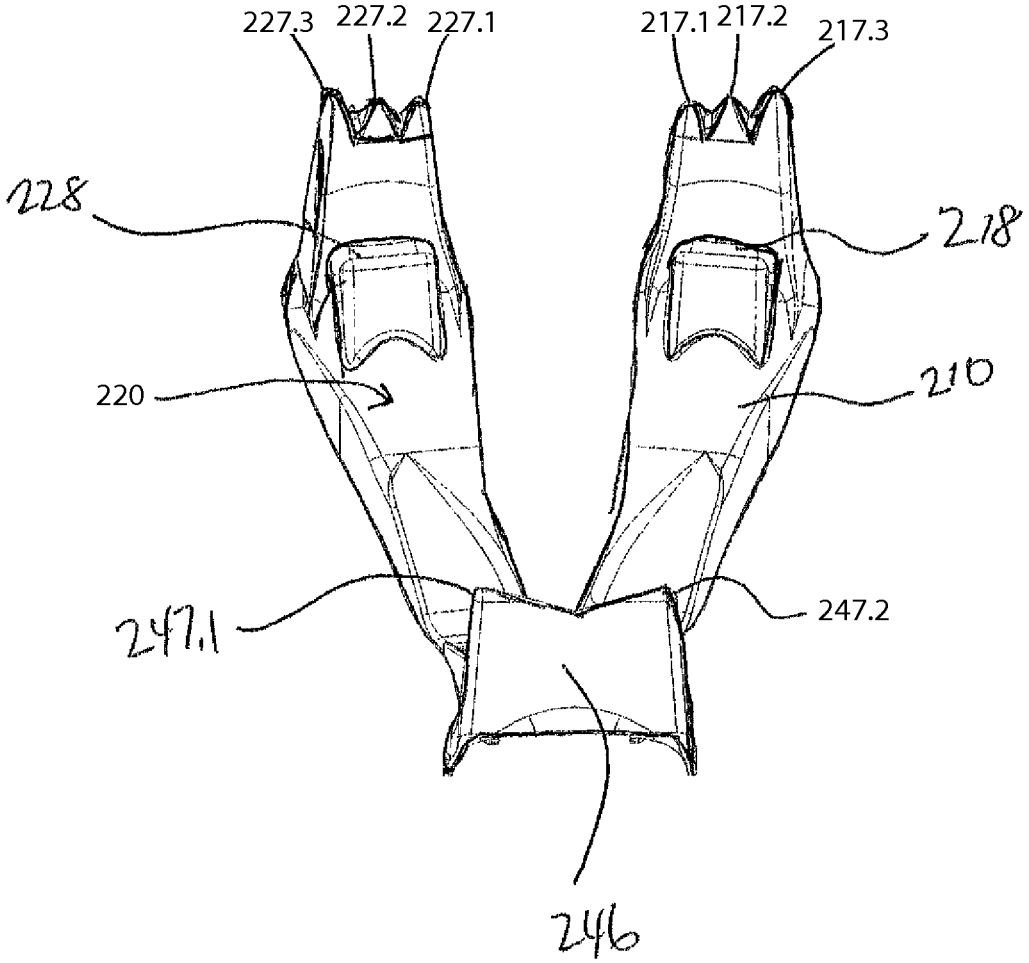
FIG. 17 is a front perspective view.

FIG. 17 is a front end view of the embodiment shown in FIG. 12. this view shows limbs 210 and 220 as well as their associated tines or teeth 217.1, 217.2, 217.3 which are coupled to limb 210, tines or teeth 227.1, 227.2, and 227.3 which is coupled to limb 220, and tines or teeth 247.1 and 247.2 which is coupled to limb 240. These tines can also be referred to as teeth, appendages, digits, branches, prongs, points, spikes or apexes, protrusions, or nails. In this embodiment, tine 217.3 is larger or longer than tines 217.1 and 217.2, while tine 227.3 is larger or longer than tines 227.1 and 227.2 although the tines may be of equal or varied length.

Figure 18:
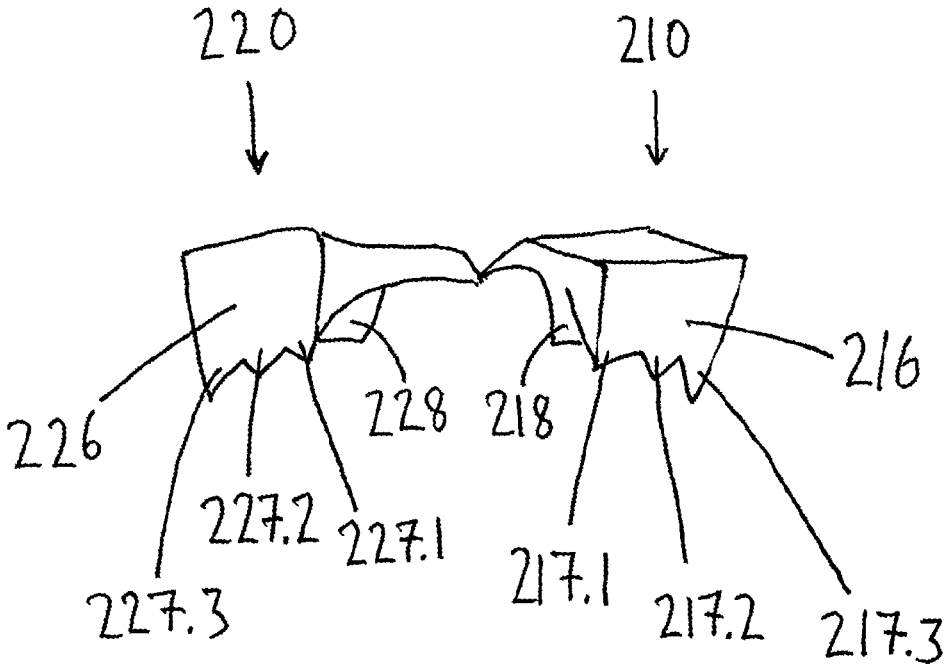
FIG. 18 is a front view of the channels.

FIG. 18 is an end view of the limbs 210 and 220 which show end caps 216 and 226 as well as tines 217.1 217.2, 217.3 and 227.1, 227.2, and 227.3. As indicated, tines 217.3 and 227.3 extend to a greater extent than tines 217.1 and 217.2 as well as tines 227.1 and 227.2. Tines 217.1, 217.2, 217.3 and 227.1, 227.2 and 227.3 extend to a point or an apex such that these tines can be used to pierce into food or other edible substances so that a user can grip food and then tear at food if necessary. The two outer tines 217.3 and 227.3 are longer than the inner tines 217.1, 217.2 and 227.1 and 227.2 so that the user has lateral control over the food and can contain the food when holding the food. Additionally, if a food has rigid elements such as bones, these elements can be constrained between the tines or V-shaped grooves.

Figure 19:
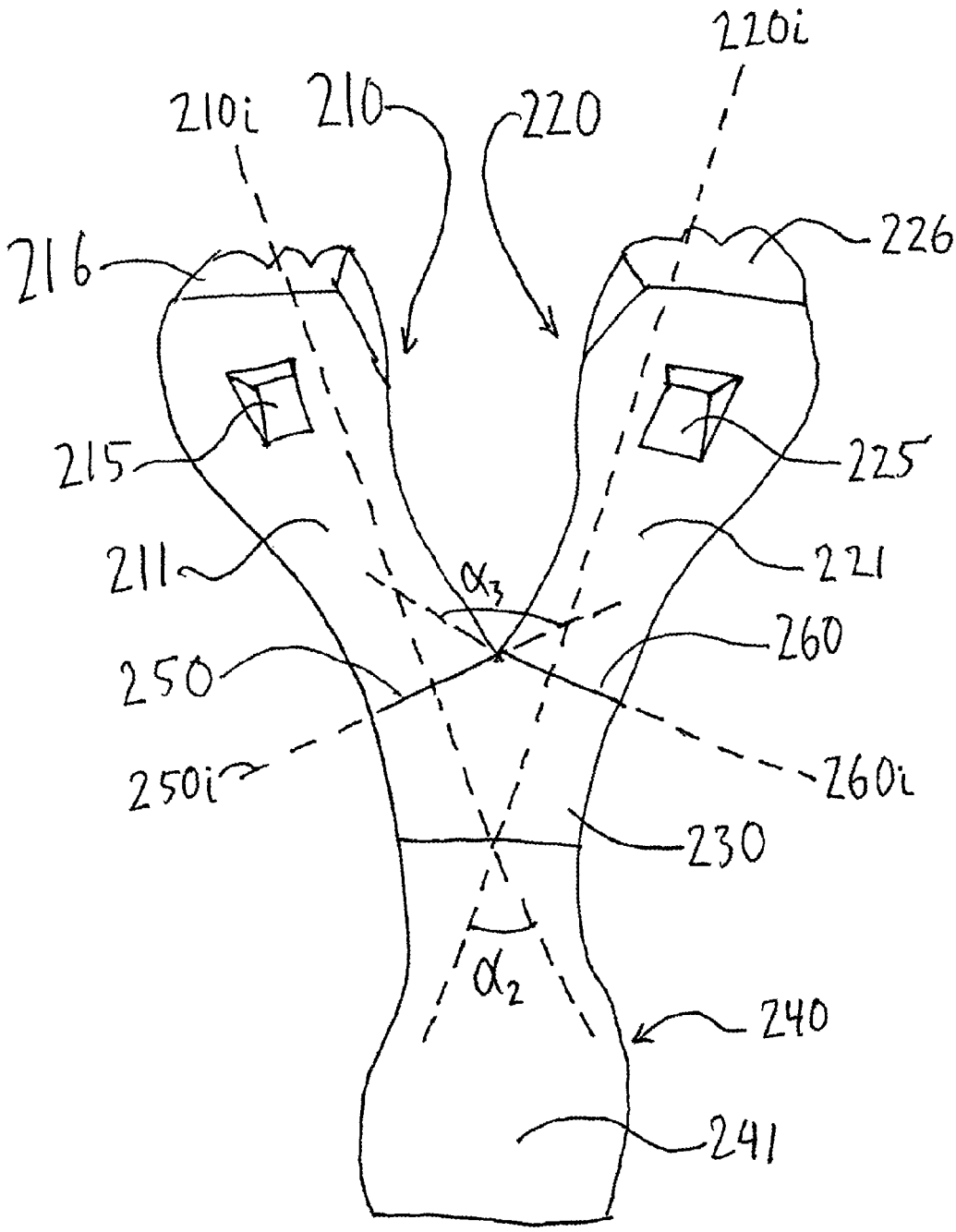
FIG. 19 is a back view of the embodiment shown in FIG. 12.

FIG. 19 is a back view of the device 200 which shows limbs 210 and 220 as well as channels 211 and 221. Extending into channel 211 is indent 215, while extending into channel 221 is indent 225. In addition, the general contour or shape of channel 241 is also shown from this back side view. This view shows that channel 241 is also substantially U-shaped or semi-circular in shape as well.

Thus, with this design there are two limbs 210 and 220 which are angled with respect to each other, and which intersect at angle $alpha_2$. Angle $alpha_2$ can be any suitable angle such as approximately any one of 5, 10, 15, 20, 25, 30, 35 degrees. The hinges have an axis of rotation that is substantially perpendicular or transverse to the longitudinal extension of their respective channel Therefore, hinge 250 has an axis of rotation 250*i* which is substantially perpendicular to the longitudinal axis 210*i*, while hinge 260 has an axis of rotation 260*i* which is substantially perpendicular to the longitudinal axis 220*i*. The intersection of the angles of rotation 250*i* and 260*i* are at an angle $alpha_3$ which can be a substantial converse of angle $alpha_2$. That is, if the angle of $alpha_2$ is 20 degrees then the angle of $alpha_3$ is 160 degrees (180-20=160). This angle allows for the two limbs 210 and 220 to rotate towards each other as well as towards limb 240 when a user closes his hand around the limbs.

Figure 20:
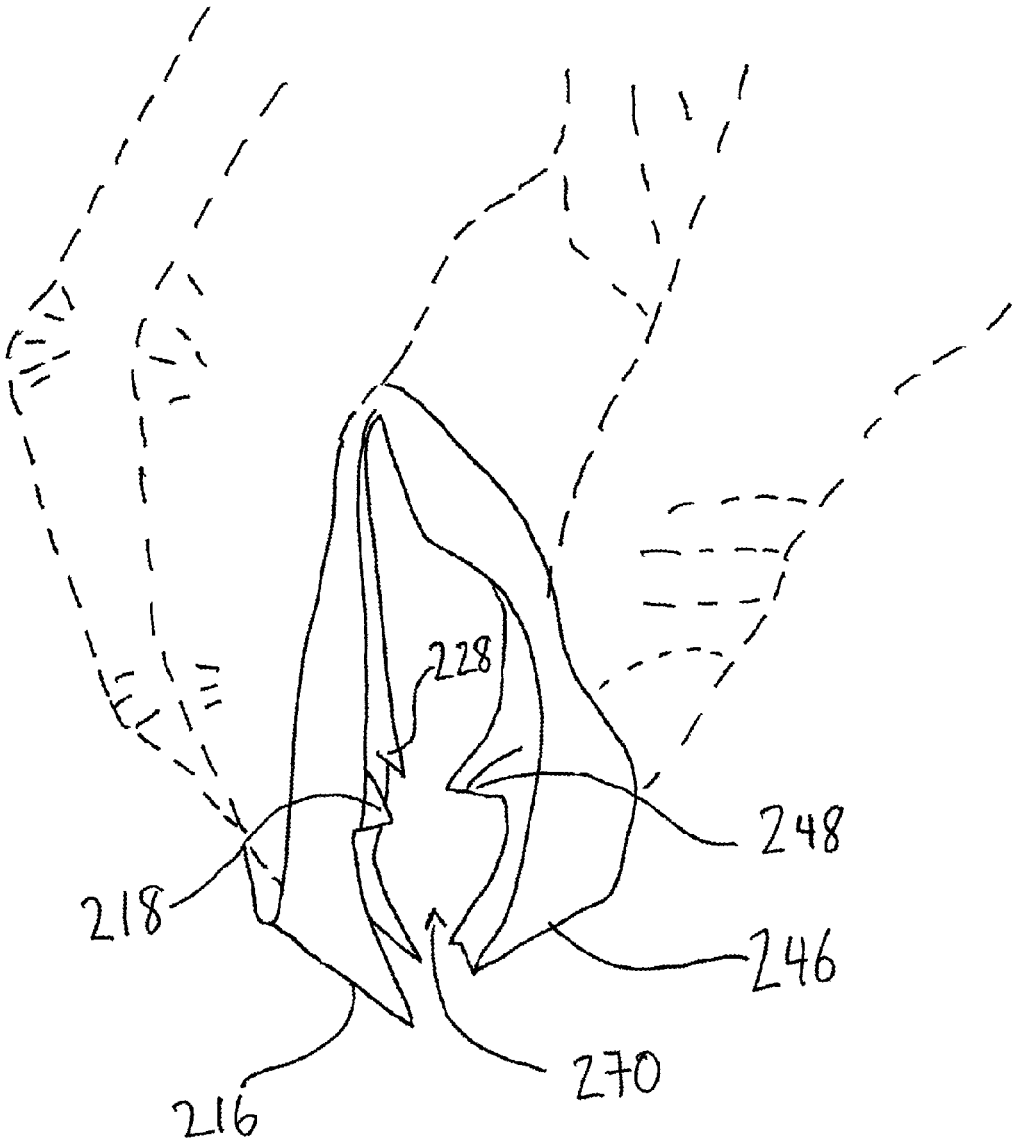
FIG. 20 is a side view of the device shown in use with a hand shown in dashed lines.

FIG. 20 is a side view of the device 200 in use with a hand shown in dashed lines. The closing of these limbs 210 and 220 vs limb 240 creates an open space 270 between tines or teeth 247.1 and 247.2 and tines or teeth 217.1, 217.2, 217.3 and 227.1, 227.2, 227.3 and protrusions 218, 228, and 248. This space is a region where a user can hold an item such as a piece of meat. In addition, the closure of these limbs 210 and 220 and 240 is configured to put tines or teeth 217, 227 and 247 in contact with each other.

Because this space 270 can be an enclosed space, the user can enclose his or her food therein and move the device 200 back and forth using at least two of these devices 200 such that a user can both push and pull on the food thereby tearing at the food. In addition, because these channels 211, 221, 241 are open channels it allows a user to easily place his or her fingers in the channels and then also easily remove his or her fingers as well. Caps 216, 226 and 246 only extend or are only configured to extend to the tips of a person's fingers and leave a substantial portion of the person's fingers as well as fingernails exposed.

In addition, disposed between the teeth such as between teeth 217.1 and 217.2 and between teeth 217.2 and 217.3 are gaps or indents which are configured to receive teeth 247.1 or 247.2. In addition between teeth 227.1 and 227.2 and between 227.2 and 227.3 are gaps or indents which are configured to receive teeth 247.1 or 247.2 thereby allowing a user a system for clamping down on food in a secure manner. This type of closure on food allows the user to grip, rip or tear at food allowing the user control over the food once it is gripped by this device 200. Furthermore, because the axis of rotation of these limbs about hinges 250 and 260 are angled to cause a user to drive limbs 210 and 220 together, this creates a gripping action that pinches and stabilizes food in multiple dimensions. Thus, this design is a simple, yet intuitive and comfortable food handling device, allowing users to handle their food in a relatively easy and mess free manner.

REFERENCE SYMBOL LIST

1 utensil/device
2 food
3 hand
5 vertical support member
6 horizontal support member
10 body section
11 first limb
12 second limb
13 third limb
14 fourth limb
21 first finger channel
22 second finger channel
23 third finger channel
24 fourth finger channel
31 first tooth
31.1 first tooth point
31.2 first tooth recess
31.3 first tooth second point
32 second tooth
32.1 point
32.2 recess point
32.3 point
33 third tooth
33.1 point
33.2 recess point
33.3 point
34 fourth tooth
34.1 point
34.2 recess point
34.3 point
41 first finger
42 second finger
43 third finger
44 fourth finger
52 second-limb hinge
53 third-limb hinge
62 second limb rotational coupling
63 third limb rotational coupling
72 second limb coil spring
73 third limb coil spring
82.1 second limb channel spring retainer pin
82.2 second limb body spring retainer pin
83.1 third limb channel spring retainer pin
83.2 third limb body spring retainer pin
98 optional reinforcing rib
99 optional reinforcing rib
100 longitudinal axis of first limb
102 longitudinal axis of third limb
104 longitudinal axis of second limb
106 axis transverse to longitudinal axis of first limb
107 axis of extension perpendicular to
108 axis of rotation of third limb
109 axis of extension of first tooth 31
110 axis of rotation of second limb
111 offset angle formed between axis 109 and axis 107
112 offset angle for third limb
114 offset angle for second limb
120 additional hinge for second finger
130 additional hinge for third finger
131 axis of extension of tooth 33
132 axis of extension perpendicular to longitudinal axis
133 offset angle formed between axis 131 and 132
134 axis of extension of tooth
135 axis perpendicular to longitudinal axis 104
136 offset angle formed between axis 134 and axis 135
200 Device
210 First leg, extension, appendage, limb, member
211 channel
212 wall
213 inner surface
214 wall
215 indent
216 end cap
217.1 tine, branch, prong, point, spike, apex
217.2 tine
217.3 tine
218 protrusion
219 gap
219 gap
220 second leg, extension, appendage, limb, member
221 channel
222 wall
223 inner surface
224 wall
225 indent
226 end
227.1 tine
227.2 tine
227.3 tine
228 protrusion
229 gap
230 back/body, frame, chassis, trunk
240 leg, extension, appendage, limb, member
241 channel
243 inner surface
245 indent, dent, depression, rut, concave, push in, pit;
246 end
247.1 tine
247.2 tine
248 protrusion
249 gap
249 gap
250 hinge
260 hinge
270 gap clamping region Accordingly, while only a few embodiments of the present invention have been shown and described, it is obvious that many changes and modifications may be made thereunto without departing from the spirit and scope of the invention.

What is claimed is:

1. A food handing device comprising:

a) at least three limbs comprising:

i) a first limb having a channel configured to receive a first digit;

ii) a second limb having a channel configured to receive a second digit;

iii) a third limb having a channel configured to receive a third digit; and b) at least one body section coupled to each of said first limb, said second limb, and said third limb; and c) at least one hinge coupled to said body section, said at least one hinge for allowing at least one of said second limb and said third limb to be movable about a rotational axis wherein at least one channel on said first limb, said second limb and said third limb are configured to allow a user to easily remove at least one digit from said channel; and d) wherein said at least one hinge is a living hinge formed as a leaf spring.

2. The device as in claim 1, wherein said first limb is disposed opposite said second limb and said third limb, wherein said first limb, said second limb and said third limb are configured so that when a user presses his digits together, which are contacting said first limb, said second limb and said third limb, said first limb, said second limb and said third limb contact each other.

3. The device as in claim 1, wherein said first limb, said second limb and said third limb each further comprise at least one tooth.

4. The device as in claim 3, wherein said first limb is disposed opposite said second limb and said third limb, wherein when said first limb, said second limb, and said third limb are configured so that when a user presses on said first limb, said second limb and said third limb, said at least one tooth from said second limb and at least one tooth of said at third limb contact at least one tooth of said first limb.

5. The device as in claim 4, wherein said first limb has a first end coupled to said body and an opposite end coupled to said at least one tooth.

6. The device as in claim 4, wherein said second limb has a first end coupled to said body via said at least one hinge and an opposite end coupled to said at least one tooth.

7. The device as in claim 4, wherein said third limb has a first end coupled to said body via said at least one hinge and an opposite end coupled to said at least one tooth.

8. The device as in claim 4, wherein said tooth of said first limb comprises at least one concave shaped tooth.

9. The device as in claim 4, wherein each tooth of said first limb, said second limb, and said third limb are each shaped as a concave tooth having at least two points.

10. The device as in claim 1 , wherein said hinge is formed from an integral connection between at least one of said second limb, said third limb and said body.

11. The device as in claim 1, wherein said channels of said at least three limbs each have at least two sides.

12. The device as in claim 1, wherein said channels of said at least three limbs each have closed ends.

13. A device comprising:

a) a first limb configured to receive a digit;

b) a second limb configured to receive a digit;

c) a third limb configured to receive a digit;

d) a body coupled to said first limb, said second limb and said third limb;

e) at least two hinges coupling said second limb and said third limb to said body wherein when a user clamps down on said second limb and said third limb, said second limb is drawn towards said first limb at a first preset fixed angle and said third limb is drawn towards said first limb at a second preset fixed angle wherein said at least two hinges are formed from an integral connection between at least one of said second limb, said third limb and said body wherein said first preset fixed angle intersects said second preset fixed angle.

14. The device as in claim 13, wherein said at least two hinges comprise a first hinge and a second hinge, wherein said first hinge has an axis of rotation that extends at an acute angle with respect to a longitudinal axis of said second limb, and said third limb has an axis of rotation that is an acute angle with respect to a longitudinal axis of said third limb.

15. A device comprising:

a) a first limb having a plurality of teeth;

b) a second limb having a plurality of teeth;

c) a third limb;

d) a body section coupled to said first limb, said second limb and said third limb;

e) at least two hinges, wherein said second limb is coupled to said body section via a first of said at least two hinges, and wherein said third limb is coupled to said body section via a second of said at least two hinges, wherein said at least two hinges are formed as springs wherein said limbs are configured such that they are substantially stiff except for said hinges;

f) at least one protrusion coupled to said second limb and spaced from said at least one tooth wherein said at least one protrusion and said plurality of teeth on said second limb are spaced opposite each other wherein said plurality of teeth on said second limb and said plurality of teeth on said first limb have gaps which are configured to receive teeth when the device is clamped down.

16. The device as in claim 15, wherein at least two of said plurality of teeth comprise points.

17. The device as in claim 15, wherein said at least one protrusion has a back section that is curved.

18. The device as in claim 15, wherein said at least one protrusion has a triangular cross-section.

19. The device as in claim 15, wherein when said second limb is pressed against said first limb said protrusion and said tooth form a gap.

* * * * *